United States Patent [19]

Garfinkle

[11] Patent Number: 4,881,707

[45] Date of Patent: Nov. 21, 1989

[54] SIGN HOLDER DEVICE

[75] Inventor: Benjamin L. Garfinkle, Alameda, Calif.

[73] Assignee: Clamp Swing Pricing Co., Alameda, Calif.

[21] Appl. No.: 314,379

[22] Filed: Feb. 23, 1989

[51] Int. Cl.[4] ..... A47B 96/00

[52] U.S. Cl. ..... 248/221.4; 40/642; 248/278; 248/289.3

[58] Field of Search ..... 248/221.4, 225.1, 220.2, 248/221.3, 223.3, 278, 280.1, 283, 289.3, 289.1, 900, 145, 485, 487; 40/642; 211/94, 102, 175; 403/93, 97, 291

[56] References Cited

U.S. PATENT DOCUMENTS

| | | | |
|---|---|---|---|
| 851,012 | 4/1907 | Lanius . | |
| 1,089,143 | 3/1914 | Mayer . | |
| 1,408,636 | 3/1922 | Power . | |
| 1,567,195 | 12/1925 | Rousseau . | |
| 2,518,538 | 8/1950 | Giblin . | |
| 2,759,620 | 8/1956 | Pharris . | |
| 2,787,433 | 4/1957 | Slavsky et al. . | |
| 2,830,394 | 4/1958 | Gordon et al. . | |
| 2,981,018 | 4/1961 | Hopp et al. . | |
| 3,499,626 | 3/1970 | Baker . | |
| 3,742,209 | 6/1973 | Williams | 248/278 X |
| 4,068,889 | 1/1978 | Pierce . | |
| 4,616,799 | 10/1986 | Rebentisch | 248/289.3 |
| 4,670,938 | 6/1987 | Fowlston . | |
| 4,708,312 | 11/1987 | Rohr | 248/280.1 |
| 4,733,846 | 3/1988 | Kakinuma | 248/289.3 X |
| 4,776,116 | 11/1988 | Shuman | 40/642 |
| 4,786,025 | 11/1988 | Shuman | 248/558 X |

*Primary Examiner*—Ramon O. Ramirez

*Attorney, Agent, or Firm*—Limbach, Limbach & Sutton

[57] ABSTRACT

A sign holder assembly encompassing a frame member capable of supporting and displaying a sign in a vertical orientation. A hinge is appended to the frame member for maintaining the frame member in a vertical orientation which allows the frame movement in a horizontal plane while preventing significant movement of the frame in a vertical direction. An attachment member is provided for securing the frame through the hinge to a horizontal shelf and a connector is provided for attaching the hinge to the attachment member which is capable of allowing rotation of the frame member about the connector about a horizontal axis while maintaining the frame member in a vertical orientation.

7 Claims, 1 Drawing Sheet

SIGN HOLDER DEVICE

TECHNICAL FIELD OF INVENTION

The present invention relates generally to a device employed as a sign holder uniquely applicable to supermarket or grocery store applications.

BACKGROUND OF THE INVENTION

In supermarkets, grocery stores and other environments where virtually each product must be identified by some type of sign, there has been a continuous need for a sign holder which is capable of bringing the shopper's attention to a specific item offered for sale, which eliminates the drawbacks of commonly employed sign holder devices. Most noticeably, signs of this type tend to require significant care in maintaining the sign frame in a substantially vertical plane adjacent the item made the subject of the display. Due to the rather heavy pedestrian traffic encountered in modern supermarket environments, signs emanating from display shelves tend to receive transverse impact which can result both in loss of vertical orientation as well as a displacement of the sign and information above or below the merchandise being sold.

It is thus an object of the present invention to provide a sign holder assembly which can absorb transverse impact while exhibiting an elastic "memory" resulting in the sign frame returning to a substantially vertical orientation.

It is yet a further object of the present invention to provide a sign holder assembly which is capable of rotating about a horizontal axis.

These and further objects will be more fully appreciated when considering the following disclosure and appended drawings wherein.

SUMMARY OF THE INVENTION

In its broadest terms, the sign holder assembly of the present invention comprises, in combination, a frame member capable of supporting and displaying a sign in a substantially vertical orientation. Connected to the frame member is a hinge means for supporting the frame member and for maintaining the frame member in a substantially vertical orientation. The hinge means is further characterized as comprising a plurality of stria formed of a flexible material, said stria connecting adjacent rib sections enabling the hinge means to flex horizontally in response to a horizontally or transversely applied impact while preventing significant flex in a vertical direction.

Attachment means is provided for securing the frame member through the hinge means to a substantially horizontally oriented shelf. A connector means is provided for attaching the hinge means to the attachment means. The connector means is capable of allowing rotation of the frame member about the connector means in a substantially vertical orientation.

DETAILED DESCRIPTION OF THE INVENTION

Figure 2:
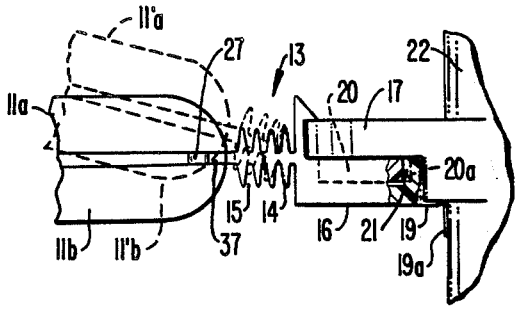
FIG. 2 is a top plan view of the hinge means of the sign holder assembly.

The present invention can be more readily perceived by referring to the appended drawings. More specifically, sign holder assembly 10 firstly comprises a frame member 11 capable of supporting and displaying a sign (not shown) in a substantially vertical orientation within space 12. Preferably, the frame member comprises frame halves 11A/11B (FIG. 2) whereby one of the frame halves possesses a protruding male member engageable with complementary female members possessed by the second frame half. When engaged, the male/female interconnect is shown in FIG. 2 by element 27.

Figure 1:
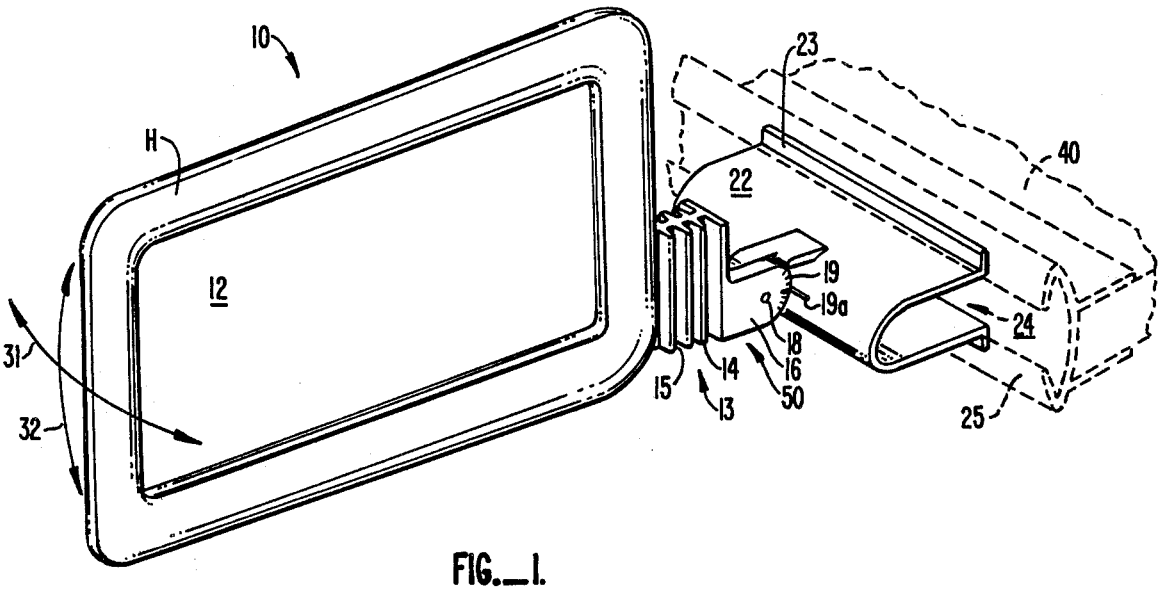
FIG. 1 is a perspective view of the complete sign holder assembly of the present invention.

A hinge means 13 is provided for supporting frame 11 and for maintaining the frame member in a substantially vertical orientation. The hinge means comprises a plurality of stria 15 which is formed of a flexible material such as a thermoplastic elastomer. Resilient hinge 13 enables the frame member 11 to hingeably swing on a horizontal plane in the direction depicted by arrow 31. The resilient nature of hinge 13 enables frame member 11 to return to its predetermined vertical orientation as shown in FIG. 1 and prevents the frame member from hingeably swinging in any direction other than that depicted by arrow 31 regardless of the angle of impact imparted as a glancing blow by the sign user or customer. As such, if one were to inflict a glancing blow to frame member 11, frame halves 11A/11B would temporarily be displaced as shown in phantom (FIG. 2) as elements **11'*a*/11'*b*. However, frame member 11** would immediately return to its at-rest position without suffering any permanent change in orientation.

As a preferred embodiment, hinge 13 is provided with flat section 37. Flat section 37 is intended to fit between frame halves 11A/11B and to be frictionally engaged between said frame halves when the halves are snap fit together. As a further embodiment, holes can be placed within flattened section 37 to accommodate the passage of male/female connectors 27 to further aid in securing the frame to the hinge.

Preferably, sign holder assembly 10 is intended to protrude from a supermarket or grocery shelf 40. This can most conveniently be arranged by providing an attachment means 24 possessing U-shaped member 22 and outwardly facing protruding flat sections 23. In use, U-shaped member 22 can flex such that the legs of the U are caused to move closer to one another. Outwardly facing protruding flat sections 23 can then engage a segment of C-shaped channel molding 25 located on the onward edge of shelf 40.

Figure 3:
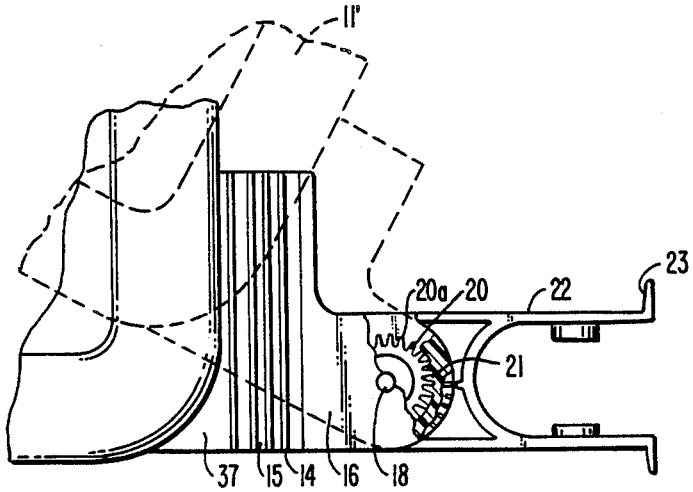
FIG. 3 is a side plan view of the hinge assembly and connector means of the present invention.

As previously noted, the present invention also contemplates the use of a connector means for attaching the hinge means to the attached means. The connector means is designed to be capable of allowing rotation of the frame member about the connector means in a substantially vertical orientation as shown in phantom by element 11' (FIG. 3).

Connector means 50 is composed of a first body part 17 suporting ribbed wheel-shaped member 20 displaying circumferentially disposed ribs 20A. Preferably, body part 17 and ribbed wheel-shaped member 20 can be molded as a unitary plastic piece with attachment means 22.

As a complement to ribbed wheel-shaped member 20 is provided connector body part 16 which is ideally maintained in rotatable contact with connector body part 17 by pin 18. Pin 18, which can be a screw or other suitable member allows for rotation of the hinge and appended frame member 11 about a horizontal axis. Ideally, grooved surface 21 is caused to mate with ribbed wheel-shaped member 20 to maintain the orientation of the hinge and appended frame member in a specific angular orientation to attached means 20 and shelf 40. Connector body part 16 can be molded as a unitary plastic piece with hinge means 13.

To achieve reproducible orientation of frame 11 about pin 18, connector body half 16 is provided with scores 19. As such, by aligning scores 19 with marker 19A, the angular relationship of the various members can be reproduced.

Although a specific embodiment of the invention has been illustrated and described, it will be understood that various alterations and the details of construction can be made without departing from the scope of the invention as indicated by the appended claims.

I claim:

1. A sign holder assembly comprising in combination:

(a) a frame member capable of supporting and displaying a sign in a substantially vertical orientation;

(b) hinge means for supporting said frame member and for maintaining said frame member in a substantially vertical orientation, said hinge means being further characterized as comprising a plurality of stria formed of a flexible material, said stria connecting adjacent rib sections enabling said hinge means to flex horizontally in response to a horizontally applied impact being applied to said frame member but preventing significant flex in a vertical direction;

(c) attachment means for securing said frame member through said hinge means to a substantially horizontally oriented shelf; and (d) connector means for attaching said hinge means to said attachment means, said connector means being capable of allowing rotation of said frame member about a horizontal axis while maintaining said frame member in a substantially vertical orientation.

2. The sign holder assembly of claim 1 wherein said attachment means comprises a substantially U-shaped member possessing outwardly facing protruding flat sections for engaging a segment of channel molding located on and supported by said shelf.

3. The sign holder assembly of claim 1 wherein said frame member comprises two frame halves, a first half possessing protruding male members engageable with complementary female members possessed by a second frame half such that the frame halves are capable of being snap-fit together by joining said male and female members.

4. The sign holder assembly of claim 3 wherein said hinge means further comprises a substantially flat section capable of being inserted between said frame halves and held between said frame halves upon the joining of said male and female members.

5. The sign holder assembly of claim 1 wherein said connector means comprises a ribbed wheel-shaped member emanating from said attachment means and a complimentary grooved surface emanated from said hinge means wherein said ribbed wheel-shaped member and said grooved surface mate to maintain said frame member in a substantially fixed orientation.

6. The sign holder assembly of claim 5 wherein said connector means is scored with visible markings to enable the fixed orientation of said frame member to be reproducibly established.

7. The sign holder assembly of claim 5 wherein a pin is located through said wheel-shaped member and grooved surface such that said hinge means and appended frame member are capable of rotating about a horizontal axis at said pin.

* * * * *